US009683702B2

(12) United States Patent
Chang et al.

(10) Patent No.: US 9,683,702 B2
(45) Date of Patent: Jun. 20, 2017

(54) APPARATUS FOR PRESSURIZING DELIVERY OF LOW-TEMPERATURE LIQUEFIED MATERIAL

(75) Inventors: Dae Jun Chang, Ulsan (KR); Su Won Seo, DaeJeon (KR); Jun Young Kim, DaeJeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 692 days.

(21) Appl. No.: 13/990,613

(22) PCT Filed: Nov. 30, 2011

(86) PCT No.: PCT/KR2011/009184
§ 371 (c)(1),
(2), (4) Date: Aug. 15, 2013

(87) PCT Pub. No.: WO2012/074283
PCT Pub. Date: Jun. 7, 2012

(65) Prior Publication Data

US 2013/0327421 A1 Dec. 12, 2013

(30) Foreign Application Priority Data

| | | |
|---|---|---|
| Nov. 30, 2010 | (KR) | 10-2010-0120930 |
| Mar. 3, 2011 | (KR) | 10-2011-0019161 |
| May 31, 2011 | (KR) | 10-2011-0052476 |
| Jul. 29, 2011 | (KR) | 10-2011-0075840 |

(51) Int. Cl.

| | |
|---|---|
| ***F17C 7/02*** | (2006.01) |
| ***F17C 9/02*** | (2006.01) |
| ***F17C 5/06*** | (2006.01) |

(52) U.S. Cl.
CPC ..... *F17C 7/02* (2013.01); *F17C 5/06* (2013.01); *F17C 9/02* (2013.01); *F17C 2201/0109* (2013.01); *F17C 2201/035* (2013.01); *F17C 2201/054* (2013.01); *F17C 2205/018* (2013.01); *F17C 2205/0338* (2013.01);
(Continued)

(58) Field of Classification Search
CPC combination set(s) only.
See application file for complete search history.

(56) References Cited

U.S. PATENT DOCUMENTS 2,489,514 A * 11/1949 Benz ..... F17C 7/04 137/339
2,632,302 A * 3/1953 Steele ..... F17C 9/00 137/210
(Continued)

FOREIGN PATENT DOCUMENTS

JP 2002160901 A 6/2002
JP 2004332757 A 11/2004
(Continued)

*Primary Examiner* — Kevin Murphy
*Assistant Examiner* — Jonathan Waddy
(74) *Attorney, Agent, or Firm* — The Webb Law Firm

(57) ABSTRACT

The present invention relates to an apparatus for pressurizing delivery of a low-temperature liquefied material, and more particularly, to an apparatus for pressurizing delivery of a low-temperature liquefied material, which can convert the low-temperature liquefied material into a high-pressure gas and easily deliver the gas without causing changes in a composition and flashing phenomenon.

9 Claims, 12 Drawing Sheets

(52) U.S. Cl.
CPC .. *F17C 2221/033* (2013.01); *F17C 2221/035* (2013.01); *F17C 2223/0153* (2013.01); *F17C 2223/0161* (2013.01); *F17C 2223/033* (2013.01); *F17C 2223/046* (2013.01); *F17C 2225/0123* (2013.01); *F17C 2225/035* (2013.01); *F17C 2225/036* (2013.01); *F17C 2227/0107* (2013.01); *F17C 2227/0135* (2013.01); *F17C 2227/0302* (2013.01); *F17C 2227/0374* (2013.01); *F17C 2227/0393* (2013.01); *F17C 2250/01* (2013.01); *F17C 2260/056* (2013.01); *F17C 2265/017* (2013.01); *F17C 2265/05* (2013.01); *Y10T 137/6416* (2015.04)

(56) References Cited

U.S. PATENT DOCUMENTS 2,682,154 A * 6/1954 Wilkinson ..... F17C 13/02 62/48.2
2,922,289 A * 1/1960 Freeman, Jr. ..... F17C 7/04 62/50.2
5,937,655 A * 8/1999 Weiler ..... F17C 7/04 62/50.1
6,023,933 A * 2/2000 Langan ..... F17C 9/02 62/50.2
7,135,048 B1 * 11/2006 Edlund ..... B01J 8/0278 422/110
7,147,690 B2 12/2006 Shimada et al.
7,438,012 B2 10/2008 Kackur
7,721,557 B1 * 5/2010 Stearns ..... F17C 7/02 62/48.2
2002/0157402 A1 * 10/2002 Drube ..... F17C 5/007 62/50.1
2007/0068176 A1 * 3/2007 Pozivil ..... F17C 3/025 62/45.1
2007/0125122 A1 * 6/2007 Mak ..... F17C 3/00 62/620
2008/0190117 A1 * 8/2008 Lee ..... F17C 3/00 62/47.1
2009/0217676 A1 * 9/2009 Mak ..... F17C 6/00 62/50.1
2010/0122542 A1 * 5/2010 Choi ..... F17C 9/02 62/50.5
2013/0263609 A1 * 10/2013 Mackey ..... F17C 13/02 62/49.1
2014/0318503 A1 * 10/2014 Kang ..... F02M 37/0052 123/506

FOREIGN PATENT DOCUMENTS

JP 2005063703 A * 3/2005
KR 1020060124759 A 12/2006

* cited by examiner

[FIG. 1] PRIOR ART
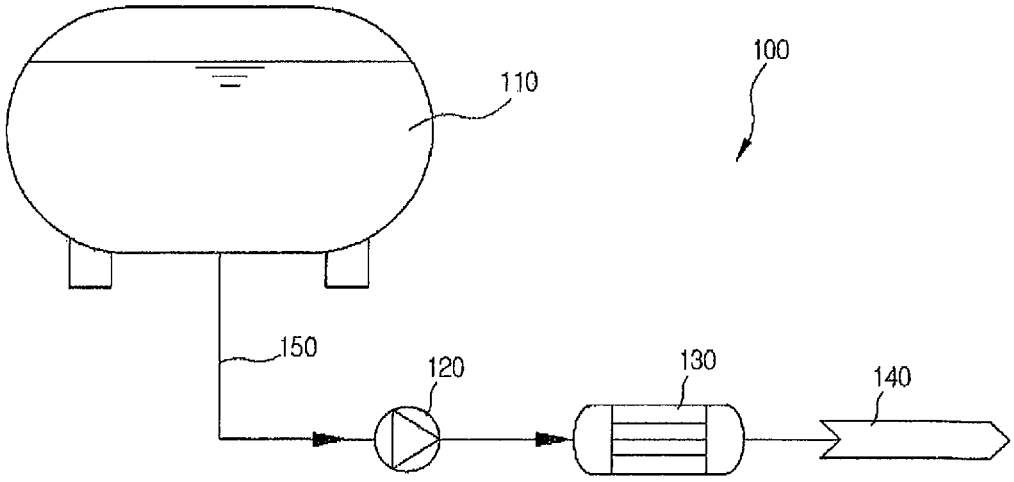
[FIG. 2] PRIOR ART
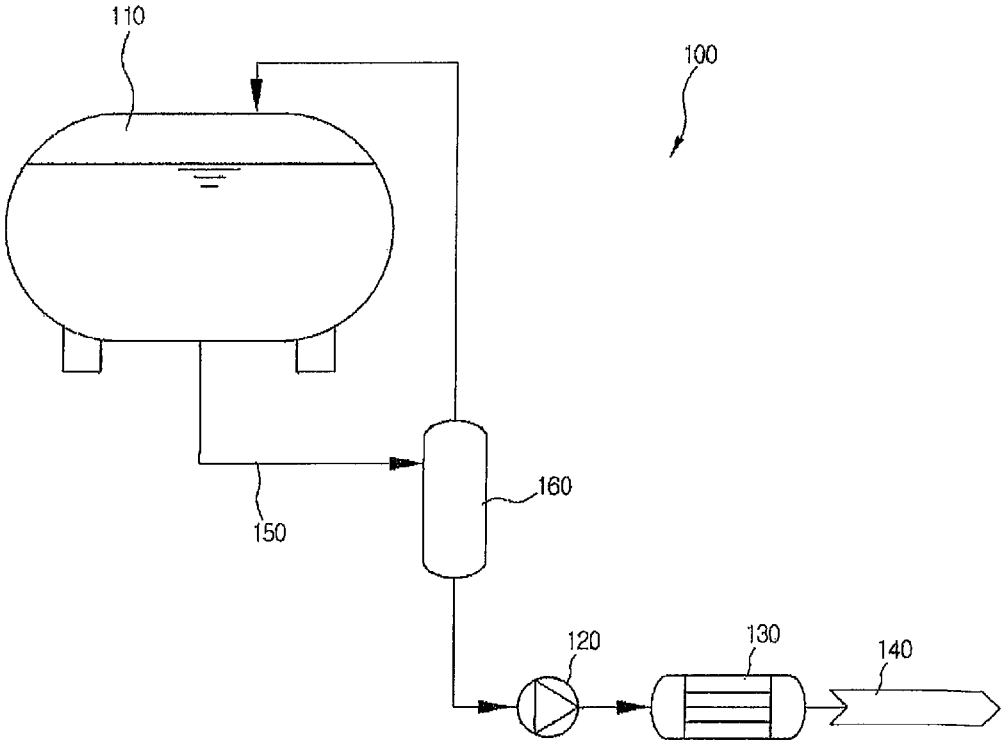

[FIG. 3] PRIOR ART
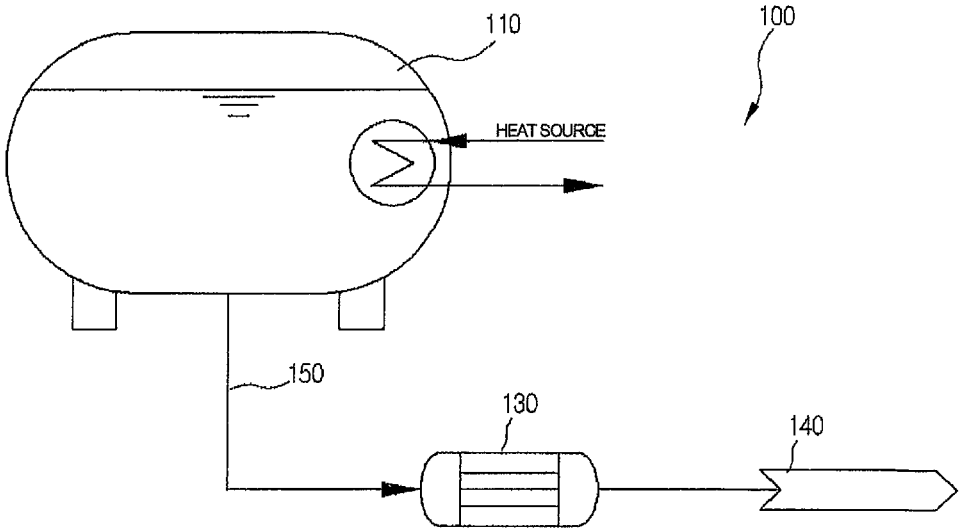
[FIG. 4]
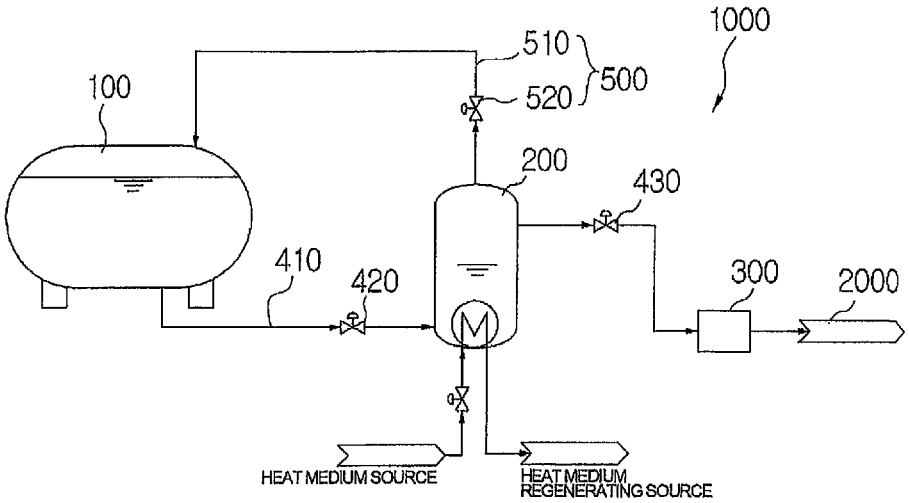

[FIG. 5]
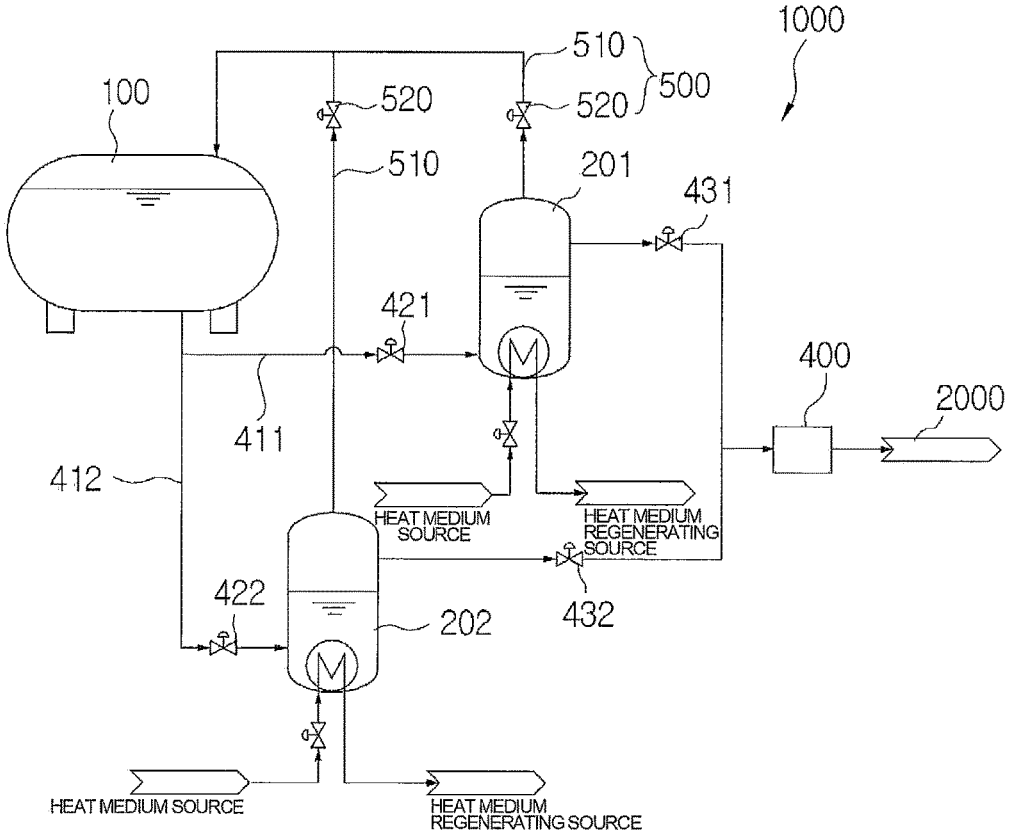

[FIG. 6]
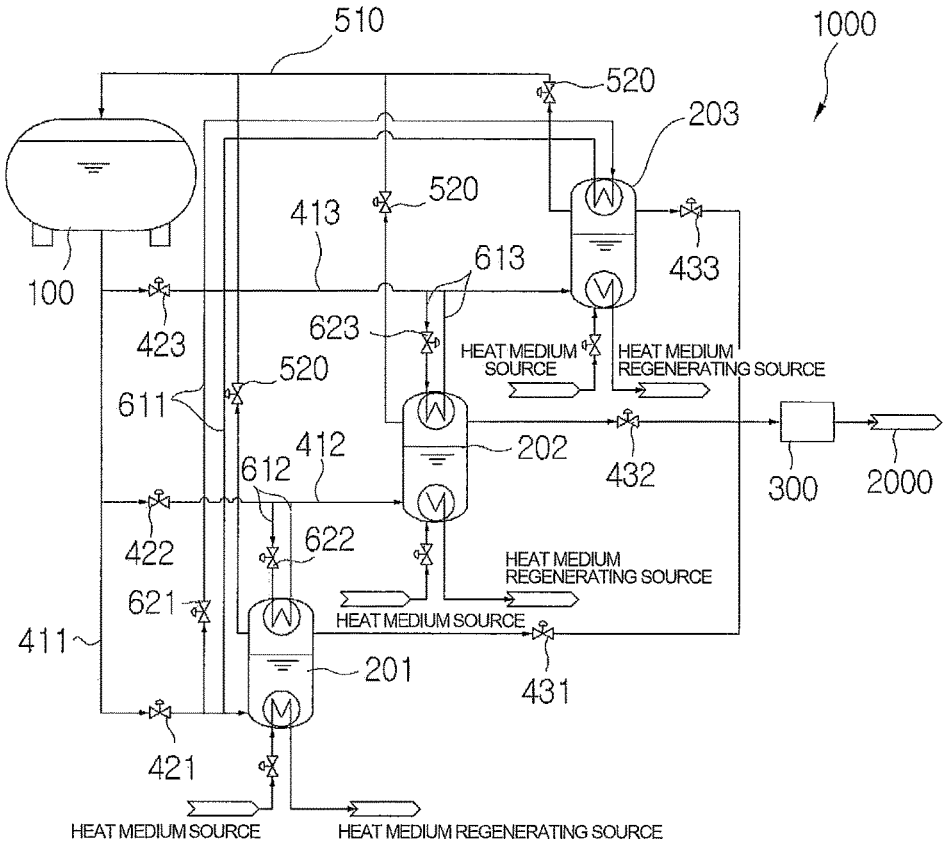
[FIG. 7]
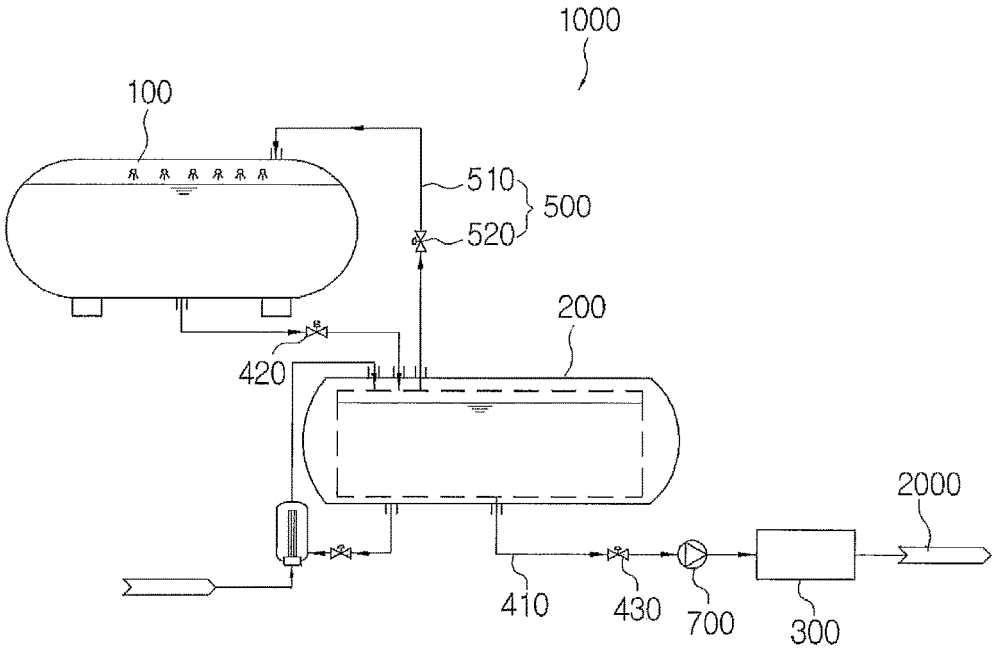

[FIG. 8]
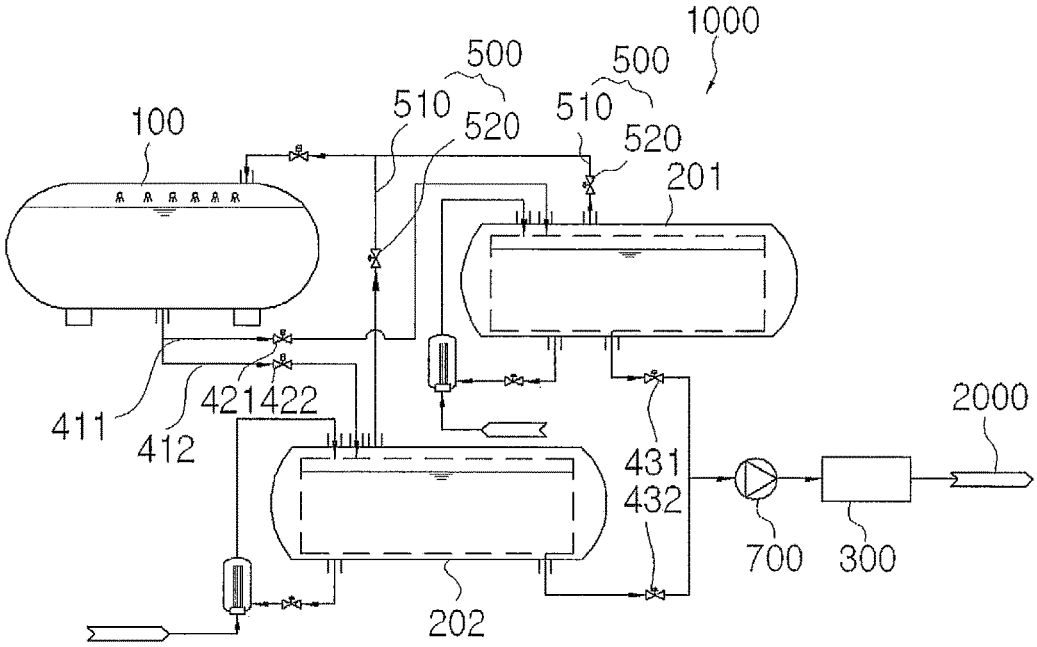

[FIG. 9]
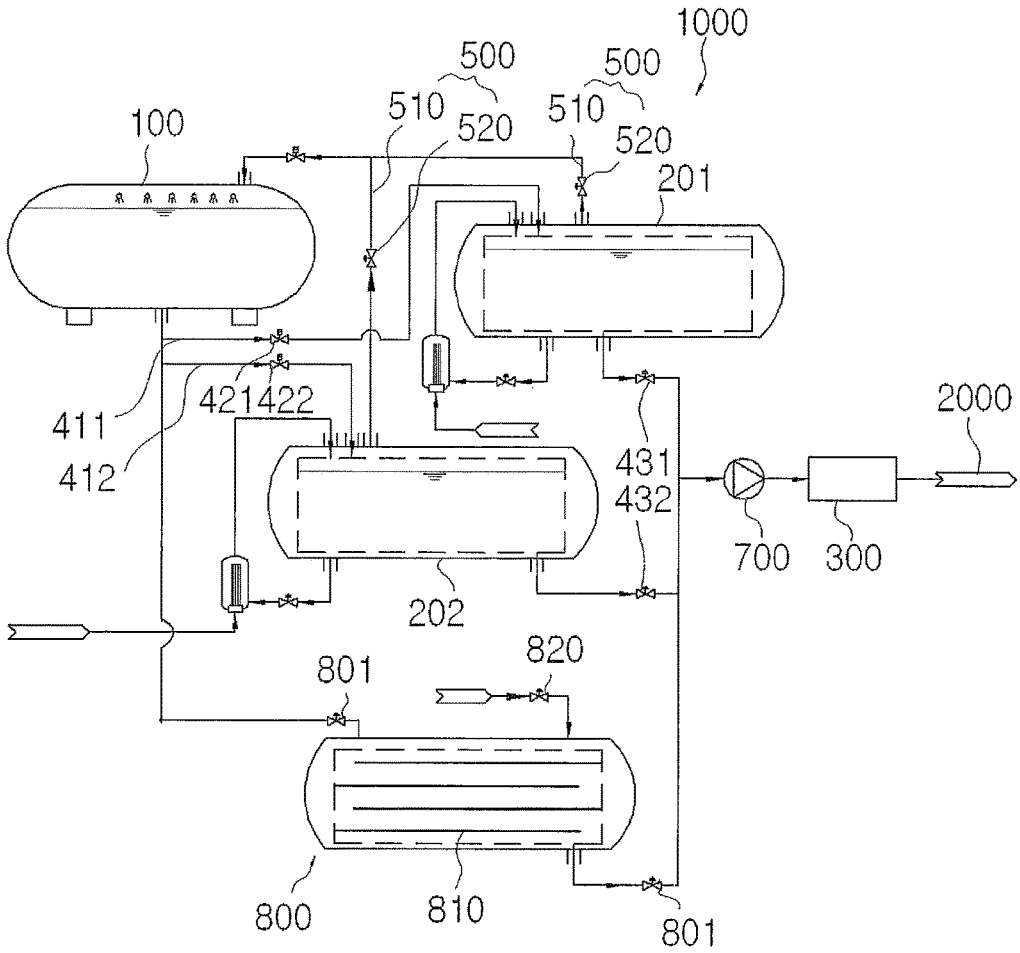

[FIG. 10]
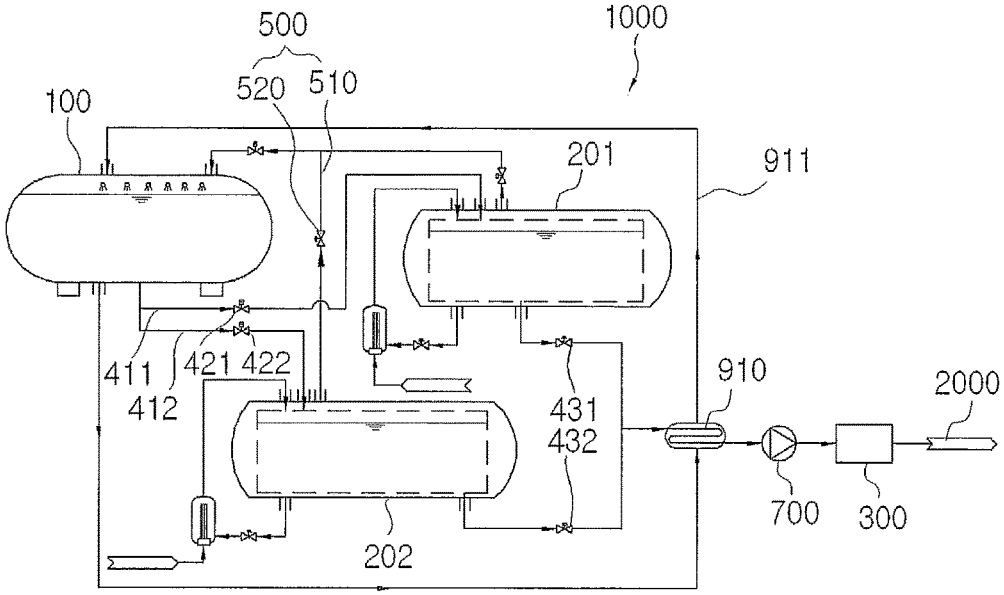
[FIG. 11]
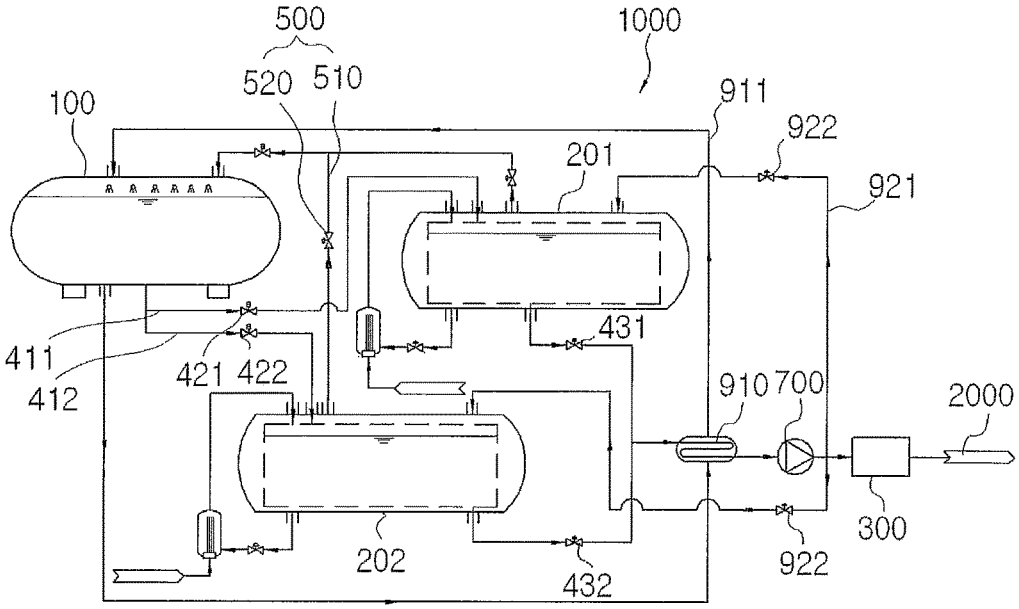

[FIG. 12]
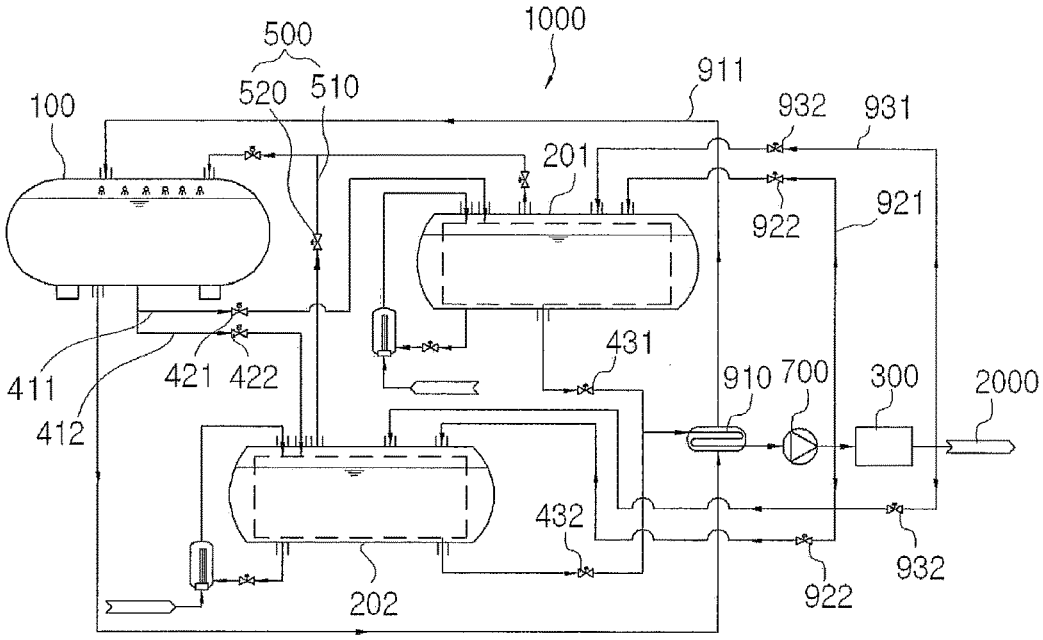
[FIG. 13]
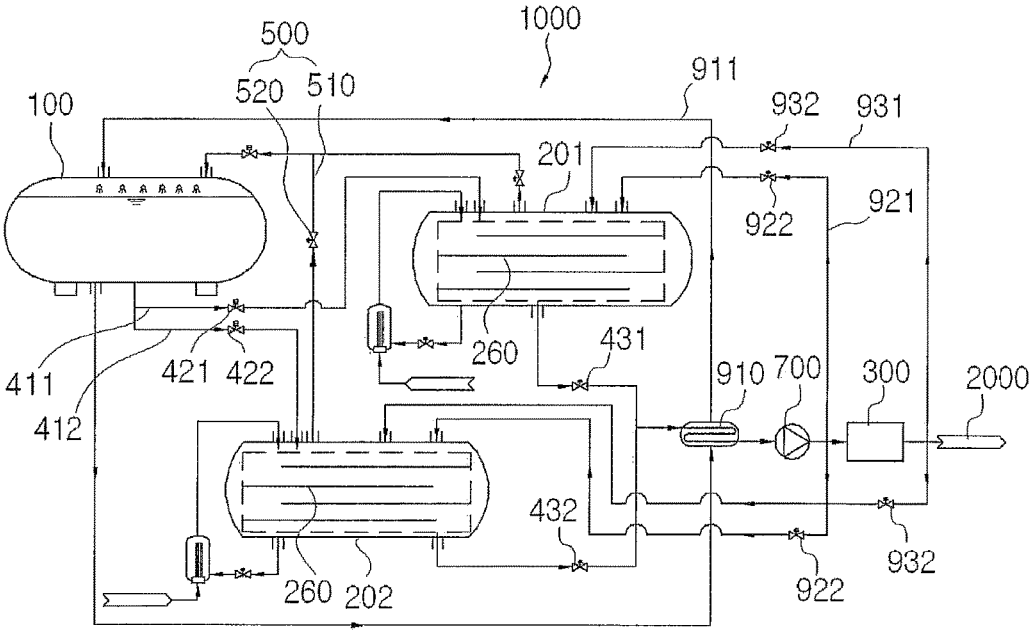

APPARATUS FOR PRESSURIZING DELIVERY OF LOW-TEMPERATURE LIQUEFIED MATERIAL

TECHNICAL FIELD

The present invention relates to an apparatus for pressurizing delivery of a low-temperature liquefied material, and more particularly, to an apparatus for pressurizing delivery of a low-temperature liquefied material, which can convert the low-temperature liquefied material into a high-pressure gas and easily deliver the gas without causing changes in a composition and flashing phenomenon.

BACKGROUND ART

Generally, pressurizing delivery of a low-temperature liquefied material for converting the low-temperature material into a liquid or a gas having higher pressure and temperature by pressurizing or heating the low-temperature liquefied material in order to supply the low-temperature liquefied material such as an LNG, an LPG, and the like to a high-pressure gas employment is demanded.

However, in the pressurizing delivery of the low-temperature liquefied material according to the related art, there are several problems.

First, in an apparatus 100 for pressurizing delivery of the low-temperature liquefied material shown in FIG. 1, a pressure of the liquefied material is increased by a pump 120 and a temperature thereof is increased by a vaporization heater 130, such that the liquefied material is supplied to a fuel consuming source 140.

In this case, in the apparatus 100 for pressurizing delivery of the low-temperature liquefied material, heat penetration may be generated at a pipe 150 between a low-temperature liquefied material tank 110 and the pump 120 due to the low-temperature liquefied material. Due to the heat penetration, a part of the low-temperature liquefied material is evaporated within the pipe 150, such that bubbles are generated in the liquefied material and mechanical damage to the pump 120 may be thus generated.

Second, the apparatus 100 for pressurizing delivery of the low-temperature liquefied material as shown in FIG. 2 is an example designed to improve the problem of FIG. 1.

The apparatus 100 for pressurizing delivery of the low-temperature liquefied material of FIG. 2 has an intermediate tank 160 further installed between the low-pressure liquefied material tank 110 and the pump 120 in order to remove the bubbles in the liquefied material which was the problem of FIG. 1. The apparatus 100 for pressurizing delivery of the low-temperature liquefied material may remove the most bubbles by the intermediate tank 160 to thereby reduce risk of the damage to the pump 120, but has a disadvantage that the intermediate tank 160 should be additionally installed.

Third, the apparatus 100 for pressurizing delivery of the low-temperature liquefied material as shown in FIG. 3 is an example designed to improve the problem of FIG. 2.

The apparatus 100 for pressurizing delivery of the low-temperature liquefied material of FIG. 3 heats the low-pressure liquefied material tank material 110 itself so that the intermediate tank 160 which was the problem due to the apparatus 100 for pressurizing delivery of the low-temperature liquefied material as shown in FIG. 2 needs not to be additionally installed.

The apparatus 100 for pressurizing delivery of the low-temperature liquefied material increases the pressure of the low-pressure liquefied material tank 110 itself using steam generated by heating the low-pressure liquefied material tank 110. This method has an advantage in that the intermediate tank 160 and the pump 120 need not to be installed as compared to the apparatus 100 for pressurizing delivery of the low-temperature liquefied material shown in FIG. 2, but has a disadvantage in that since the pressure in the large low-pressure liquefied material tank 110 is increased, cost for manufacturing the low-pressure liquefied material tank 110 is increased and the leakage risk is increased.

Therefore, a development of an apparatus for pressurizing delivery of a low-temperature liquefied material capable of solving the problems as described above and converting the low-temperature material into a liquid or a gas having higher pressure and temperature by pressurizing or heating the low-temperature liquefied material in order to supply the low-temperature liquefied material to a high-pressure gas employment is demanded.

In addition, the apparatus for pressurizing delivery of the low-temperature liquefied material as described above has problems in that a composition ratio of the gas supplied to the consuming source may be changed and the gas in the composition having a high boiling point may be accumulated in the apparatus for pressurizing delivery according to the repetition of a process delivering a high-pressure gas by the heating the consuming source.

Particularly, a methane gas having a relative low boiling point is easily supplied to the high-pressure gas consuming source, while butane having a relative high boiling point is hardly transported and remains.

In addition, the change in the composition ratio may change methane number of the high-pressure gas and cause a knocking phenomenon to the consuming source, thereby degrading durability of the high-pressure employment.

In the case of the heater according to the related art used for heating the liquefied material or adjusting the pressure of the liquefied material, quantity of heat used for heating is all absorbed into a heater container, as it is. The absorbed quantity of heat is discharged to a low-pressure low-temperature and liquefied material tank when a new liquefied material is supplied from the low-pressure and low-temperature liquefied material tank. However, since the change in the pressure of the low-pressure and low-temperature liquefied material tank in a fuel gas supplying system is very important for safety reasons, the introduction of the quantity of heat from the heater described above causes stability to degrade.

Therefore, a design of the heater having the quantity of heat smaller than that of the related art is demanded in order to enable the quantity of heat introduced to the low-pressure and low-temperature liquefied material tank to be reduced.

DISCLOSURE

Technical Problem

An object of the present invention is to provide an apparatus for pressurizing delivery of a low-temperature liquefied material capable of distributing heating capacity by using a pressurizing part and a heat adjusting part, converting the low-temperature liquefied material into a high-pressure gas, and easily delivering the low-temperature liquefied material by an adjustment of a supplying valve and an adjusting valve.

Particularly, an object of the present invention is to provide an apparatus for pressurizing delivery of a low-temperature liquefied material capable of preventing changes in the composition of the liquefied material in a process of pressurizing and delivery of the liquefied material without pressurizing a liquefied material tank itself.

In addition, an object of the present invention is to provide an apparatus for pressurizing delivery of a low-temperature liquefied material capable of preventing the liquefied material or gas from being flowing backward by adjusting a pressure balance between the liquefied material tank and the pressurizing part using a pressure adjusting part included therein.

Further, an object of the present invention is to provide an apparatus for pressurizing delivery of a low-temperature liquefied material capable of increasing delivery efficiency of a high-pressure gas by forming N connection pipes which is branched into a plurality of connection pipes and by forming the pressurizing parts, the supplying valve, and the adjusting valve of a total number of N so as to correspond to the respective connection pipes and easily adjusting a delivery amount of the high-pressure gas in consideration of a consuming type of a fuel consuming source.

Technical Solution

In one general aspect, an apparatus 1000 for pressurizing delivery of a low-temperature liquefied material converting the low-temperature liquefied material into a gas form and supplying the converted gas form to a fuel consuming source 2000 includes: a liquefied material tank 100 storing a low-temperature and low-pressure liquefied material; a pressurizing part 200 including a heating unit 250 to pressurize the low-temperature and low-pressure liquefied material supplied from the liquefied material tank 100; a heat adjusting part 300 adjusting a high-temperature and high-pressure liquefied material passing through the pressurizing part 200 to a necessary temperature and pressure of the fuel consuming source 2000; a connecting pipe 410 connecting the liquefied material tank 100, the pressurizing part 200, the heat adjusting part 300, and the fuel consuming source 2000 to one another; a supplying valve 420 formed on the connecting pipe 410 connecting between the liquefied material tank 100 and the pressurizing part 200; an adjusting valve 430 formed on the connecting pipe 410 connecting between the pressurizing part 200 and the heat adjusting part 300; and a pressure adjusting part 500 including a parallel pipe connecting between the liquefied material tank 100 and the pressurizing part 200, and a pressure balance valve 520 provided on the parallel pipe 510 and adjusting a pressure to achieve pressure balance between the liquefied material tank 100 and the pressurizing part 200.

The connecting pipe 410 connecting between the liquefied material tank 100 and the heat adjusting part 300 may include first to N-th connecting pipes 411 to 41N, the pressurizing part 200 may include first to N-th pressurizing parts 201 to 20N installed on the first to N-th connecting pipes 411 to 41N, respectively, the supplying valve 420 may include first to N-th supplying valves 421 to 42N installed at front sides of the first to N-th pressurizing parts 201 to 20N on the first to N-th connecting pipes 411 to 41N, respectively, the adjusting valve 430 may include first to N-th adjusting valves 431 to 43N installed at rear sides of the first to N-th pressurizing parts 201 to 20N on the first to N-th connecting pipes 411 to 41N, respectively, and the pressure adjusting part 500 may adjust the pressure so that the pressure balance between the liquefied material tank 100 and the first to N-th pressurizing parts 201 to 20N is achieved (where N is an integer of 2 or more).

The apparatus 1000 for pressurizing delivery of a low-temperature liquefied material may further include: first to N-th circulating lines 611 to 61N from which the first to N-th connecting pipes 411 to 41N supplying the liquefied material to the first to N-th pressurizing parts 201 to 20N are branched so as to circulate in the remaining one of the first to N-th pressurizing parts 201 to 20N and are again joined, and first to N-th circulating valves 621 to 62N provided on the first to N-th circulating lines 611 to 61N to adjust a circulating flow of the liquefied material.

The apparatus 1000 for pressurizing delivery of a low-temperature liquefied material may further include a high-pressure pump 700 pressurizing the liquefied material at the front side of the heat adjusting part 300 of the connecting pipe 410.

The apparatus 1000 for pressurizing delivery of a low-temperature liquefied material may further include an auxiliary pressurizing part 800 provided between the liquefied material tank 100 and the heat adjusting part 300 in parallel with the pressurizing part 200 by the branched connecting pipe 410 and pressurizing the low-temperature and low-pressure liquefied material supplied from the liquefied material tank 100 by having a high-pressure gas supplying part supplying a high-pressure inert gas formed therein, and wherein the low-temperature and low-pressure liquefied material transported from the liquefied material tank 100 by an adjustment of an auxiliary supplying valve 801 adjusting the flow of the liquefied material supplied to the supplying valve 420 and the auxiliary pressurizing part 800 may be selectively supplied to one of the pressurizing part 200 and the auxiliary pressurizing part 800.

The auxiliary pressurizing part 800 may have a plurality of first baffles 810 spaced in a height direction provided therein and alternately extended from left and right sides, respectively, such that the liquefied material introduced into the auxiliary pressurizing part 800 flows in a zigzag form.

The apparatus 1000 for pressurizing delivery of a low-temperature liquefied material may further include an over-cooling part 910 over-cooling the liquefied material passing through the pressurizing part 200 or the auxiliary pressurizing part 800 at a front side of the high-pressure pump 700 of the connecting pipe 410.

The over-cooling part 910 may be connected to the inside of the liquefied material tank 100 by a first transport pipe 911, and the liquefied material supplied through the connecting pipe 410 may be heat-exchanged with the low-temperature liquefied material supplied through the first transport pipe 911 so as to be over-cooled.

The apparatus 1000 for pressurizing delivery of a low-temperature liquefied material may further include a second transport pipe 921 branched from the connecting pipe 410 connecting between the high-pressure pump 700 and the heat adjusting part 300 and a second transport valve 922 provided on the second transport pipe 921.

The apparatus 1000 for pressurizing delivery of a low-temperature liquefied material may further include a third transport pipe 931 branched from the connecting pipe 410 connecting between the heat adjusting part 300 and the fuel consuming source 2000 and a third transport valve 932 provided on the third transport pipe 931.

The apparatus 1000 for pressurizing delivery of a low-temperature liquefied material may further include a plurality of second baffles 260 spaced in the inside of the pressurizing part 200 in the height direction and alternately extended from the left and right sides, respectively.

The pressurizing part 200 may include: a pressure container 210 having a liquefied material injecting nozzle 211 connected to the connecting pipe 410 and spraying the supplied liquefied material into the inside and a discharging part 212, an internal container 220 having an opened one side, received in the pressure container 210, and receiving the liquefied material therein, and an insulation supporter 221 supporting the internal container 220 to be spaced from the pressure container 210 so that heat transfer from the pressure container 210 to the internal container 220 is blocked.

The internal container 220 may be formed of a material having a specific heat lower than the pressure container 210.

The apparatus 1000 for pressurizing delivery of a low-temperature liquefied material may further include a sensing unit 230 measuring a state of the liquefied material received in the internal container 220.

The sensing unit 230 may include a thermocouple 231 provided outside the internal container 220 and measuring a temperature of the liquefied material received in the internal container 220.

The sensing unit 230 may include a level control (LC) 232 measuring a level of the liquefied material received in the internal container 220.

The heating unit 250 may be included in the internal container 220, have a form of a heat exchanger 251 in which a heating medium source having a relatively higher temperature than the liquefied material included in the internal container 220 flows, and heat the liquefied material by heat-exchanging the liquefied material with the heating medium source.

The heating medium source may use steam or brine.

The heating unit 250 may be a heating line 253 in which an internal heat source is heated by a power supply 254 and the heating line 253 is attached to the outside of the internal container 220.

The heating unit 250 may include an inlet and an outlet in communication with the internal container 220 by penetrating through the pressure container 210 so that the liquefied material in the internal container 220 is circulated and heated to thereby heat the entire internal container 220, a circulating path 256 in which the liquefied material in the internal container 220 is circulated by connecting between the inlet and the outlet, and an external heat source 255 formed on the circulating path 256.

The external heat source 255 may be in a form of the heat exchanger 251 heating the liquefied material by heat-exchanging the heating medium source having a relatively higher temperature than the liquefied material passing through the circulating path 256 with the liquefied material and heat the liquefied material by heat-exchanging the liquefied material with the heating medium source.

The external heat source 255 may be in a form of an electrical heater 252 using power.

The pressurizing part 200 may further include an external insulation material 240 provided outside the pressure container 210 and conducting the insulation.

Advantageous Effects

Therefore, the apparatus for pressurizing delivery of a low-temperature liquefied material according to the embodiment of the present invention may distribute the heating capacity by using the pressurizing part and the heat adjusting part, convert the low-temperature liquefied material into the high-pressure gas, and easily deliver the low-temperature liquefied material by adjusting the supplying valve and the adjusting valve.

Particularly the apparatus for pressurizing delivery of a low-temperature liquefied material according to the embodiment of the present invention may prevent changes in composition of the liquefied material in a process of pressurizing and delivery of the liquefied material without pressurizing the liquefied material tank itself.

In addition, the apparatus for pressurizing delivery of a low-temperature liquefied material according to the embodiment of the present invention may prevent the liquefied material or gas from flowing backward by adjusting pressure balance between the liquefied material tank and the pressurizing part using the pressure adjusting part included therein.

Further, the apparatus for pressurizing delivery of a low-temperature liquefied material according to the embodiment of the present invention may increase delivery efficiency of the high-pressure gas by forming N connection pipes which is branched into a plurality of connection pipes and by forming the pressurizing parts, the supplying valve, and the adjusting valve of a total number of N so as to correspond to the respective connection pipes and easily adjusting a delivery amount of the high-pressure gas in consideration of the consuming type of the fuel consuming source.

DESCRIPTION OF DRAWINGS

The above and other objects, features and advantages of the present invention will become apparent from the following description of preferred embodiments given in conjunction with the accompanying drawings, in which:

FIG. 1 is a schematic view showing an apparatus for pressurizing delivery of a low-temperature liquefied material according to the related art;

FIG. 2 is a schematic view showing another apparatus for pressurizing delivery of a low-temperature liquefied material according to the related art;

FIG. 3 is a schematic view showing still another apparatus for pressurizing delivery of a low-temperature liquefied material according to the related art;

FIGS. 4 to 13 are views showing first to tenth embodiment of an apparatus for pressurizing delivery of a low-temperature liquefied material according to the present invention, respectively;

DETAILED DESCRIPTION OF MAIN ELEMENTS

Figure 14:
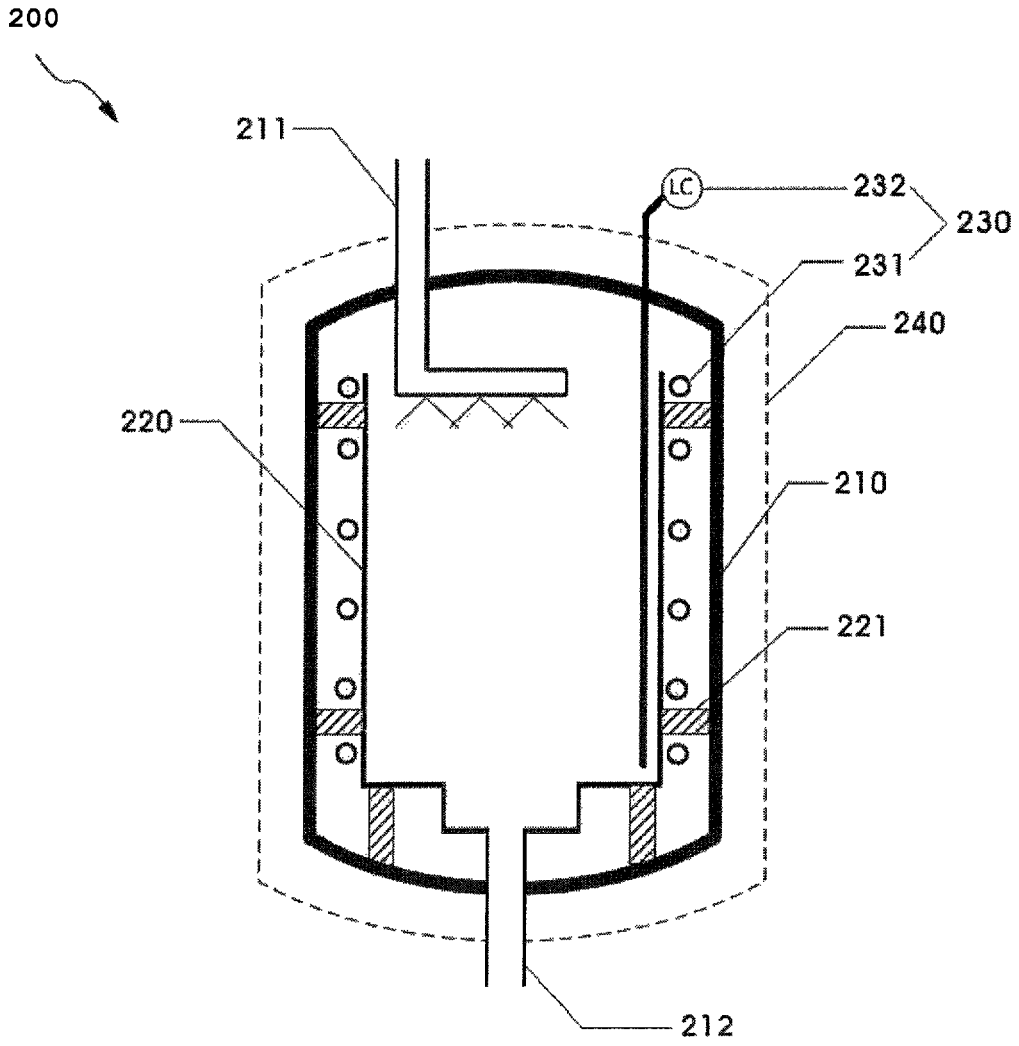
FIG. 14 is a view showing a pressurizing part of the apparatus for pressurizing delivery of the low-temperature liquefied material according to the embodiment of the present invention.

1000: apparatus for pressurizing delivery of low-temperature liquefied material
100: liquefied material tank
200: pressurizing part (201: first pressurizing part, 20N: N-th pressurizing part)
210: pressure container 211: injecting nozzle
212: discharging part
220: internal container
221: insulating supporter 230: sensing unit
231: thermocouple 232: level control (LC)
240: external insulation material
250: heating unit
251: heat exchanger 252: electrical heater
253: heating line 254: power supply

255: external heat source 256: circulating path
260: second baffle
300: heat adjusting part
410: connecting pipe (411: first connecting pipe, 41N: N-th connecting pipe)
420: supplying valve (421: first supplying valve, 42N: N-th supplying valve)
430: adjusting valve (431: first adjusting valve, 43N: N-the adjusting valve)
500: pressure adjusting part
510: parallel pipe 520: pressure balance valve
611: first circulating line 61N: N-th circulating line
621: first circulating valve 62N: N-th circulating valve
700: high-pressure valve
800: auxiliary pressurizing part
801: auxiliary supplying valve
810: first baffle 820: opening and closing valve (inert gas)
910: over-cooling part 911: first transport pipe
921: second transport pipe 922: second transport valve
931: third transport pipe 932: third transport valve
2000: fuel consuming source

BEST MODE

Hereinafter, an apparatus 1000 for pressurizing delivery of a low-temperature liquefied material according to an exemplary embodiment of the present invention having the above-mentioned characteristics will be described in more detail with reference to the accompanying drawings.

An apparatus 1000 for pressurizing delivery of a low-temperature liquefied material according to an embodiment of the present invention is configured to include a liquefied material tank 100, a pressurizing part 200, a heat adjusting part 300, a connecting pipe 410, a supplying valve 420, an adjusting valve 430, and a pressure adjusting valve 500.

First Embodiment

FIG. 4 is a view showing a first embodiment of the present invention, where the liquefied material tank 100 is a tank in which a low-temperature and low-pressure liquefied material is stored and the liquefied material stored in the liquefied material tank 100 sequentially passes through the pressurizing part 200 and the heat adjusting part 300 through the connecting pipe 410 and is transported to a fuel consuming source 2000.

The pressurizing part 200 includes a heating unit 250, where the low-temperature and low-pressure liquefied material supplied from the liquefied material tank 100 is heated by the heating unit 250 and changed in a state to a high-temperature and high-pressure liquefied material.

The pressurizing part 200 is provided with a predetermined space in which the liquefied material is stored, where the low-temperature and low-pressure liquefied material is heated and pressurized by the heating unit 250 and is converted into the high-temperature and high-pressure liquefied material.

The first embodiment (FIG. 4) has shown an example that the pressurizing part 200 heats the liquefied material by a heat medium source supplied from an outside to an inside.

(The pressurizing part 200 may be formed in various forms and a description thereof will be again described below.)

The heat adjusting part 300 has a configuration in which the high-temperature and high-pressure liquefied material passing through the pressurizing part 200 is adjusted to a necessary temperature and pressure of the fuel consuming source 2000, where the fuel consuming source 2000 generally needs a gas state, such that the heat adjusting part 300 may convert the high-temperature and high-pressure liquefied material into a high-pressure gas state using various methods.

Although FIG. 4 does not show a detailed configuration of the heat adjusting part 300, as an example, the high-temperature and high-pressure liquefied material is transported to the inside of the heat adjusting part 300 and a steam having the temperature higher than the high-temperature and high-pressure liquefied material is moved from the outside, such that the high-temperature and high-pressure liquefied material may be heated.

In addition, as the heat adjusting part 300, a unit of heating using power may be used.

The supplying valve 420 has a configuration in which it is formed at the connecting pipe 410 connecting between the liquefied material tank 100 and the pressurizing part 200, where a flow of the liquefied material supplied from the liquefied material tank 100 to the pressurizing part 200 is adjusted by opening and closing of the supplying valve 420.

The adjusting valve 430 has a configuration in which it is formed at the connecting pipe 410 connecting between the pressurizing part 200 and the heat adjusting part 300, where a flow of the liquefied material supplied from the pressurizing part 200 to the heat adjusting part 300 is adjusted by opening and closing of the adjusting valve 430.

Although FIG. 4 shows an example of the connecting pipe 410 formed so that an upper side of the pressurizing part 200 and the heat adjusting part 300 are connected, the connecting pipe 410 may be connected to various positions.

The pressure adjusting part 500 has a configuration adjusting pressure balance between the liquefied material tank 100 and the pressurizing part 200, and includes a parallel pipe 510 and a pressure balance valve 520.

The parallel pipe 510 has a configuration connecting the liquefied material tank 100 and the pressurizing part 200 separately from the connecting pipe 410 and the pressure balance valve 520 is provided on the parallel pipe 510 and adjusts the pressure to achieve the pressure balance between the liquefied material tank 100 and the pressurizing part 200.

The pressure balance valve, 520 adjusts the pressure in the liquefied material tank 100 and the pressurizing part 200 by an opening and closing operation thereof.

When adjusting the pressure balance between the liquefied material tank 100 and the pressurizing part 200 by the operation of the pressure balance valve 520, the supplying valve 420 and the adjusting valve 430 formed at the connecting pipe 410 connected to the liquefied material tank 100 and the pressurizing part 200 need to be maintained in a closed state.

The pressure adjusting part 500 may maintain a flow in which the liquefied material stored in the liquefied material tank 100 is supplied to the pressurizing part 200, the heat adjusting part 300, and the fuel consuming source 2000 by preventing flow backward due to an internal pressure change.

That is, in the apparatus 1000 for pressurizing delivery of the low-temperature liquefied material according to the embodiment of the present invention, the inner pressure may be adjusted by the pressure adjusting part 500 and the liquefied material may be easily transported by adjusting the supplying valve 420 and the adjusting valve 430.

In addition, the apparatus 1000 for pressurizing delivery of the low-temperature liquefied material according to the embodiment of the present invention may convert the low-temperature and low-pressure liquefied material into the high-pressure gas by sequentially passing through the low-temperature and low-pressure liquefied material the pressurizing part 200 and the heat adjusting part 300, and may supply the high-pressure gas to the fuel consuming source 2000.

That is, the apparatus 1000 for pressurizing delivery of the low-temperature liquefied material according to the embodiment of the present invention does not directly pressurize the liquefied material tank 100, as a result, does not need a pressure-resistant design of the liquefied material tank 100, and easily converts the low-temperature and low-pressure liquefied material into the high gas, thereby making it possible to supply the high-pressure to the fuel consuming source 2000.

Second Embodiment

FIG. 5 is a view showing a second embodiment of the present invention, where the second embodiment has the same configuration as the first embodiment, but shows an example that the pressurizing part 200 has a first pressurizing part 201 and a second pressurizing part 202.

Specifically, the second embodiment shows an example that the connecting pipe 410 connecting between the liquefied material tank 100 and the heat adjusting part 300 is branched so as to include first and second connecting pipes 411 and 412, the pressurizing part 200 includes first and second pressurizing parts 201 and 202 installed on the first and second connecting pipes 411 and 412, respectively, the supplying valve 420 includes first and second supplying valves 421 and 422 installed at front sides of the first and second pressurizing parts 201 and 202 on the first and second connecting pipes 411 and 412, respectively, the adjusting valve 430 includes first and second adjusting valves 431 and 432 installed at rear sides of the first and second pressurizing parts 201 and 202 on the first and second connecting pipes 411 and 412, respectively, and the pressure adjusting part 500 adjusts the pressure so that the pressure balance between the liquefied material tank 100 and the first and second pressurizing parts 201 and 202 is achieved.

In the second embodiment of the present invention, while the first pressurizing part 201 is operated, the second pressurizing part 202 prepares the operation thereof, such that the first pressurizing part 201 and the second pressurizing part 202 are alternately operated, thereby making it possible to increase an amount of the gas supplied to the fuel consuming source 2000 and to continuously supply the high-pressure gas.

The apparatus 1000 for pressurizing delivery of the low-temperature liquefied material is not limited to the example in which the two pressurizing parts 200 are formed and may be configured so that the connecting pipe 410 connecting between the liquefied material tank 100 and the heat adjusting part 300 includes first to N-th connecting pipes 411 to 41N, the pressurizing part 200 includes first to N-th pressurizing parts 201 to 20N installed on the first to N-th connecting pipes 411 to 41N, respectively, the supplying valve 420 includes first to N-th supplying valves 421 to 42N installed at front sides of the first to N-th pressurizing parts 201 to 20N on the first to N-th connecting pipes 411 to 41N, respectively, the adjusting valve 430 includes first to N-th adjusting valves 431 to 43N installed at rear sides of the first to N-th pressurizing parts 201 to 20N on the first to N-th connecting pipes 411 to 41N, respectively, and the pressure adjusting part 500 adjusts the pressure so that the pressure balance between the liquefied material tank 100 and the first to N-th pressurizing parts 201 to 20N is achieved (where N is an integer of 2 or more).

Third Embodiment

FIG. 6 is a view showing a third embodiment of the present invention, where the third embodiment has the same configuration as the first embodiment, but shows an example that the pressurizing part 200 has a first pressurizing part 201 to a third pressurizing part 203.

That is, the third embodiment has a configuration in which three pressurizing parts 200 are formed, and shows an example in which the connecting pipe 410 includes first to third connecting pipes 411 to 413, the pressurizing part 200 includes first to third pressurizing parts 201 to 203, the supplying valve 420 includes first to third supplying valves 421 to 423, the adjusting valve 430 includes first to third adjusting valves 431 to 433, and the pressure adjusting part 500 adjusts the pressure so that the pressure balance between the liquefied material tank 100 and the first to third pressurizing parts 201 to 203 is achieved.

In addition, the apparatus 1000 for pressurizing delivery of the low-temperature liquefied material according to the third embodiment of the present invention further includes first to third circulating lines 611 to 613 from which the first to third connecting pipes 411 to 413 supplying the liquefied material to the first to third pressurizing parts 201 to 203 are branched so as to circulate in the remaining one of the first to third pressurizing parts 201 to 203 and are again joined, and first to third circulating valves 621 to 623 provided on the first to third circulating lines 611 to 613 to adjust a circulating flow of the liquefied material.

Specifically, in FIG. 6, the first circulating line 611 is formed on the first connecting pipe 411 provided with the first pressurizing part 201 so as to pass through the third pressurizing part 203 and to then be again joined, and the first circulating valve 621 is provided on the first circulating line 611.

In addition, the second circulating line 612 is formed on the second connecting pipe 412 provided with the second pressurizing part 202 so as to pass through the first pressurizing part 201 and to then be again joined, and the second circulating valve 622 is provided on the second circulating line 612.

In addition, the third circulating line 613 is formed on the third connecting pipe 413 provided with the third pressurizing part 203 so as to pass through the second pressurizing part 202 and to then be again joined, and the third circulating valve 623 is provided on the third circulating line 613.

The third embodiment of the present invention is an example in which the pressurizing part 200 includes the first pressurizing part 201 to the third pressurizing part 203 and shows an example in which the first to third circulating lines 611 to 613 and the first to third circulating valves 621 to 623 are provided on the first to third connecting pipes 411 to 413 provided with the first to third pressurizing parts 201 to 203.

The apparatus 1000 for pressurizing delivery of the low-temperature liquefied material is not limited thereto, and the first to third circulating lines 611 to 613 may be variously formed.

In addition, when the pressurizing part 200 includes the first to N-th pressurizing parts 201 to 20N, first to N-th circulating lines 611 to 61N from which the first to N-th connecting pipes 411 to 41N supplying the liquefied material to the first to N-th pressurizing parts 201 to 20N are branched so as to circulate in the remaining one of the first to N-th pressurizing parts 201 to 20N and are again joined, and first to N-th circulating valves 621 to 62N provided on the first to N-th circulating lines 611 to 61N to adjust a circulating flow of the liquefied material may be further included (where N is an integer of 2 or more).

As for the liquefied material tank 100, when the pressure balance valve 520 is opened, the increased pressure in the pressurizing part 200 affects the liquefied material tank 100, and when the increased pressure in the pressurizing part 200 is relatively small, it may be ignored and when the increased pressure in the pressurizing part 200 is very high, the pressure of the liquefied material tank 100 may be continuously increased.

That is, the pressure in the liquefied material tank 100 may be increased by a continuous operation and the liquefied material may not be smoothly supplied. Therefore, the first to N-th circulating lines 611 to 61N and the first to N-th circulating valves 621 to 62N are to prevent the above-mentioned non-smooth supplying of the liquefied material.

Specifically, the low-temperature liquefied material before being supplied to the pressurizing part 200 positioned adjacent to the liquefied material tank 100 is indirectly heat-exchanged with the liquefied material (which is a high-temperature and high-pressure as compared to the low-temperature liquefied material) in the pressurizing part 200 and is then supplied to the pressurizing part 200, such that the pressure in the pressurizing part 200 may be decreased.

That is, the first to N-th circulating lines 611 to 61N and the first to N-th circulating valves 621 to 62N change the flow of the liquefied material before the opening of the pressure balance valve 520, such that the liquefied material may be easily transported without increasing the pressure of the liquefied material tank 100.

Fourth Embodiment

FIG. 7 is a view showing a fourth embodiment of the present invention, where the fourth embodiment has the same configuration as the first embodiment, but shows an example in which the heating unit 250 of the pressurizing part 200 is positioned outside and the liquefied material is heated and circulated.

The pressurizing part 200 may be formed to be long in a vertical direction as shown in FIGS. 4 and 5 and may be formed to be long in a horizontal direction as shown in FIG. 7.

Moreover, FIG. 7 shows an example in which a high-pressure pump 700 is further provided at the front side of the heat adjusting part 300 of the connecting pipe 410.

The high-pressure pump 700 is a unit of secondarily pressurizing the liquefied material passing through the pressurizing part 200 before the supplying of the liquefied material to the heat adjusting part 300.

That is, the apparatus 1000 for pressurizing delivery of the low-temperature liquefied material according to the fourth embodiment of the present invention may convert the low-temperature liquefied material into a high-pressure gas and easily deliver the gas without causing changes in a composition and flashing phenomenon by firstly pressurizing the liquefied material through the pressurizing part 200 and secondarily pressurizing the liquefied material through the high-pressure pump 700.

The flashing phenomenon means that the steam is generated while a saturated liquefied material in the pump is sprayed to a place at which the pressure of the saturated liquefied material is lower than a saturated pressure and the steam may cause mechanical damage to the high-pressure pump 700 driven at a high-speed.

Fifth Embodiment

FIG. 8 is a view showing a fifth embodiment of the present invention, where the fifth embodiment has the same configuration as the fourth embodiment, but shows an example in which two pressurizing, parts 200 are formed.

Specifically, the fifth embodiment shows an example that the connecting pipe 410 connecting between the liquefied material tank 100 and the heat adjusting part 300 is branched so as to include the first and second connecting pipes 411 and 412, the pressurizing part 200 includes the first and second pressurizing parts 201 and 202 installed on the first and second connecting pipes 411 and 412, respectively, the supplying valve 420 includes the first and second supplying valves 421 and 422 installed at the front sides of the first and second pressurizing parts 201 and 202 on the first and second connecting pipes 411 and 412, respectively, the adjusting valve 430 includes the first and second adjusting valves 431 and 432 installed at the rear sides of the first and second pressurizing parts 201 and 202 on the first and second connecting pipes 411 and 412, respectively, and the pressure adjusting part 500 adjusts the pressure so that the pressure balance between the liquefied material tank 100 and the first and second pressurizing parts 201 and 202 is achieved.

Sixth Embodiment

FIG. 9 is a view showing a sixth embodiment of the present invention, where the sixth embodiment has the same configuration as the fifth embodiment, but shows an example in which an auxiliary pressurizing part 800 is further provided.

The auxiliary pressurizing part 800 is provided in parallel with the pressurizing part 200 by the branched connecting pipe 410 and is selectively supplied with the low-temperature and low-pressure liquefied material.

The auxiliary pressurizing part 800 is provided between the liquefied material tank 100 and the high-pressure pump 700 and has a high-pressure gas supplying part supplying a high-pressure inert gas formed therein to pressurize the low-temperature and low-pressure liquefied material supplied from the liquefied material tank 100.

The inert gas may be a nitrogen gas and the high-pressure gas supplying part may include an opening and closing valve 82 0 for adjusting a flow of the supplied high-pressure gas.

The auxiliary pressurizing part 800 is provided in parallel with the pressurizing part 200 by the branched connecting pipe 410.

In this case, the auxiliary pressurizing part 800 may have a first baffle 810 provided therein, where the first baffle 810 prevents the high-pressure nitrogen gas and the liquefied material from being mixed and sequentially transports the liquefied material pressurized by the high-pressure nitrogen gas.

The apparatus 1000 for pressurizing delivery of the low-temperature liquefied material is provided with a plurality of first baffles 810 spaced in a height direction in the auxiliary pressurizing part 800 and alternately extended from left and right sides, respectively, such that the liquefied material introduced through the connecting pipe 410 flows in a zigzag form.

As shown in FIG. 9, the first baffle 810 is formed at inner walls of both sides of the auxiliary pressurizing part 800 in a horizontal direction, and has a configuration which is spaced apart from each other in the height direction to be provided in plural and alternately extended from left and right sides.

Moreover, the first baffle 810 may be formed in a plan shape so as to divide the inside of the pressurizing part 200 in the height direction and may be formed in a form in which the plan is divided in plural.

The apparatus 1000 for pressurizing delivery of the low-temperature liquefied material according to the embodiment of the present invention may include a plurality (N) of pressurizing parts 200 and is further provided with the auxiliary pressurizing part 800, such that the low-temperature liquefied material may be continuously delivered, and particularly, when preparing the delivery of the pressurizing part 200, the low-temperature and low-pressure liquefied material may be pressurized and transported through the auxiliary pressurizing part 800 and since the reverse driving is possible, the liquefied material may be continuously delivered.

Seventh Embodiment

FIG. 10 is a view showing a seventh embodiment of the present invention, where the seventh embodiment has the same configuration as the fifth embodiment, but shows an example in which an over-cooling part 910 is further provided.

The over-cooling part 910 is a configuration over-cooling the liquefied material passing through the pressurizing part 200 or the auxiliary pressurizing part 800 at a front side of the high-pressure pump 700 of the connecting pipe 410.

The over-cooling part 910, which is a configuration for over-cooling the liquefied material before being supplied to the high-pressure pump 700 by a cooling source, may prevent the bubble generation due to heat penetration and mechanical damage to the high-pressure pump 700 due to the flashing phenomenon and may further improve overall durability.

Particularly, the apparatus 1000 for pressurizing delivery of the low-temperature liquefied material according to the seventh embodiment of the present invention may use the low-temperature and low-pressure liquefied material stored in the liquefied material tank 100 as the cooling source of the over-cooling part.

To this end, the over-cooling part 910 is connected to the inside of the liquefied material tank 100 by a first transport pipe 911, and the liquefied material supplied through the connecting pipe 410 may be heat-exchanged with the low-temperature and low-pressure liquefied material supplied through the first transport pipe 911 and may be over-cooled.

In other words, the apparatus 1000 for pressurizing delivery of the low-temperature liquefied material according to the embodiment of the present invention uses the over-cooling part 910 as the cooling source in which the low-temperature and low-pressure liquefied material stored in the liquefied material tank 100 flows to thereby over-cool the liquefied material, thereby having a simplified configuration without wasting energy.

Eighth Embodiment

FIG. 11 is a view showing an eighth embodiment of the present invention, where the eighth embodiment has the same configuration as the seventh embodiment, but shows an example that a second transport pipe 921 branched from the connecting pipe 410 connecting between the high-pressure pump 700 and the heat adjusting part 300 and a second transport valve 922 provided on the second transport pipe 921 are further provided.

Specifically, in the eighth embodiment of the present invention, the high-temperature and high-pressure liquefied material passing through the high-pressure pump 700 is supplied to the pressurizing part 200 through the second transport pipe 921 so as to be used as a piston gas.

In the eighth embodiment of the present invention, the high-temperature and high-pressure liquefied material or gas may be used as the pressurizing source of the pressurizing part 200 with the exception of a role as an initial pressurizing source heating the pressurizing part 200, such that cost of operating the apparatus may be decreased and the change in the gas composition ratio may further be prevented.

Ninth Embodiment

FIG. 12 is a view showing a ninth embodiment of the present invention, where the ninth embodiment has the same configuration as the eighth embodiment, but shows an example that a third transport pipe 931 branched from the connecting pipe 410 connecting between the heat adjusting part 300 and the fuel consuming source 2000, and a third transport valve 932 provided on the third transport pipe 931 are further provided.

In the ninth embodiment of the present invention as shown in FIG. 12, the high-temperature and high-pressure gas passing through the heat adjusting part 300 is supplied to the pressurizing part 200 through the third transport pipe 931 so as to be used as an additional piston gas.

Tenth Embodiment

FIG. 13 is a view showing a tenth embodiment of the present invention, where the tenth embodiment has the same configuration as the ninth embodiment, but shows an example in which the pressurizing part 200 has a second baffle 260 further formed therein.

The second baffle 260 is formed similar to the form of the first baffle 810 of the auxiliary pressurizing part 800, and more particularly, is spaced in the inside of the pressurizing part 200 in the height direction and alternately formed to be extended from the left and right sides, respectively.

That is, the pressurizing part 200 is further provided with the baffle 260, such that the liquefied material may be more easily pressurized. In the configuration in which the second transport pipe 921 and the second transport valve 922 are formed or the third transport pipe 931 and the third transport valve 932 are further formed, the effect as the piston gas pushing the liquefied material may be further maximized.

Therefore, the apparatus 1000 for pressurizing delivery of the low-temperature liquefied material may convert the low-temperature and low-pressure liquefied material into the high-pressure gas and easily deliver the gas, improve durability by preventing changes in a composition and flashing phenomenon, and improve the efficiency by decreasing the driving energy.

Meanwhile, the apparatus 1000 for pressurizing delivery of the low-temperature liquefied material according to the embodiment of the present invention is configured so that the pressurizing part 200 includes a pressure container 210, an internal container 220, and an insulation supporter 221 (see FIG. 14).

The pressure container 210, which is a basic body forming the pressurizing part 200, is formed to include a liquefied material injecting nozzle 211 connected to the connecting pipe 410 and spraying the supplied liquefied material into the inside and a discharging part 212.

The internal container 220, which is in a form having one side opened, is received in the pressure container 210 to thereby receive the liquefied material therein.

Meanwhile, the internal container 220 is a space having the liquefied material received therein. In the case in which the pressurizing part 200 is further provided with the second baffle 260, as shown in FIG. 13, the second baffle 260 is spaced in the height direction of the internal container 220 and alternately formed to be extended from the left and right sides in the left and right sides, respectively.

In addition, the insulation supporter 221 supports the internal container 220 to be spaced from the pressure container so that heat transfer from the pressure container 210 to the internal container 220 is blocked.

In the case in which the pressurizing part 200 directly receives the liquefied material in the pressure container 210, the liquefied material is heated and the quantity of heat is directly transferred to the pressure container 210, such that the pressure container 210 accumulates the quantity of heat and the heat is transferred to the liquefied material tank, thereby making it possible to increase the pressure.

In the present invention capable of solving the above-mentioned problem, the pressurizing part 200 includes a separately internal container 220 in the pressure container 210 and the pressure container 210 and the internal container 220 are disposed to be spaced apart from each other by the insulating supporter 221, such that the heat capacity stored in the pressure container 210 may be minimized.

That is, in the apparatus 1000 for pressurizing delivery of the low-temperature liquefied material according to the embodiment of the present invention, even when the liquefied material is heated in the pressurizing part 200, the transfer of the quantity of heat thereof to the pressure container 210 may be maximally prevented.

Therefore, the pressurizing part 200 has a minimized quantity of heat accumulated in the pressure container 210, thereby making it possible to minimize the quantity of heat transferred to the liquefied material tank 100. Therefore, a state maintenance in the liquefied material tank 100 is much easier than the related art and ultimately, the system may be more stably operated than the related art.

In order to further increase this effect (in order to minimize the quantity of heat accumulated in the pressure container 210)' the internal container 220 is advantageously formed of a material having a specific heat lower than the pressure container 210.

As a specific example, the pressure container 210 may be formed of a stainless material and the internal container 220 may be formed of copper.

The insulation supporter 221 may minimize the direct heat transfer due to conduction by spacing the internal container 220 from the pressure container 210.

In this case, since heat conduction is generated through the insulation supporter 221, in order to prevent this problem, the insulation supporter 221 has rigidity enough to stably support the spaced interval between the pressure container 210 and the internal container 220 and is formed of a material having much lower specific heat as compared to the containers.

As a specific example of the material which may be used as the insulation supporter 221, the insulation supporter 221 may be formed of plywood.

Moreover, the pressurizing part 200 may be configured to further include an external insulation material 240 provided outside the pressure container 210 and conducting the insulation. In this case, the external insulation material 240 may be formed of a material such as polyurethane, for example.

The pressurizing part 200 has a space between the pressure container 210 and the internal container 220 by the insulation supporter 221, such that other apparatuses are further easily included in the space.

Therefore, the pressurizing part 200 may further include a sensing unit 230 measuring a state of the liquefied material received in the internal container 220.

In this case, the sensing unit 230 may include a thermocouple 231 provided outside the internal container 220 and measuring a temperature of the liquefied material received in the internal container 220. In this case, the thermocouple 231 is advantageously provided outside the internal container 220 as shown in FIG. 14 in order to prevent damage which may be generated by directly contacting the liquefied material.

In addition, the sensing unit 230 may include a level control (LC) 232 measuring a level of the liquefied material received in the internal container 220.

As such, in the apparatus 1000 for pressurizing delivery of the low-temperature liquefied material according to the embodiment of the present invention, the pressurizing part 200 may easily measure the temperature, the level, and the like of the liquefied material received therein using the sensing unit 230 such as the thermocouple 231 the LC 232, and the like. Therefore, the system may further efficiently be operated by accurately detecting the state of the liquefied material.

Figure 15:
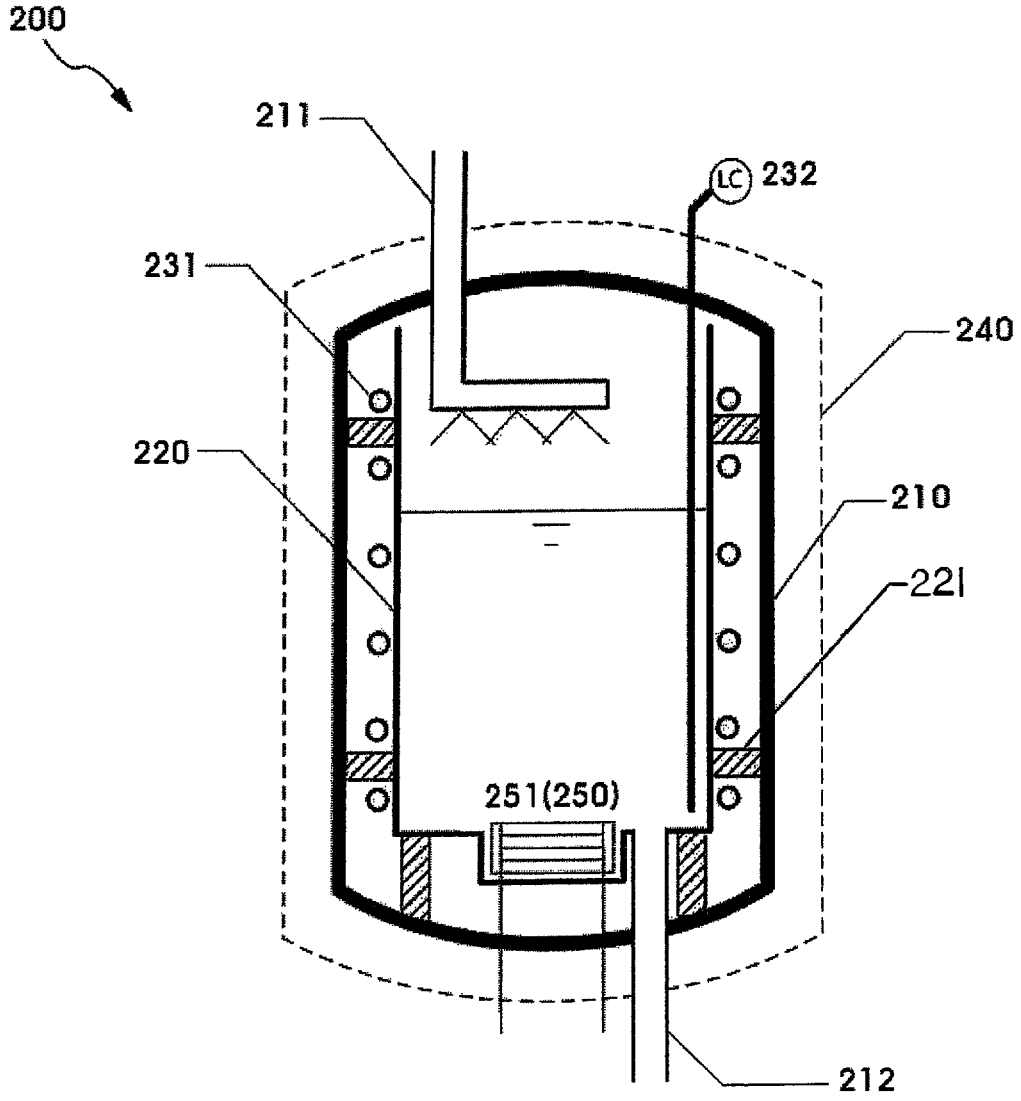
FIGS. 15 to 17 are views showing embodiments of a heating unit of the pressurizing part of the apparatus for pressurizing delivery of the low-temperature liquefied material according to the embodiment of the present invention.
Figure 16:
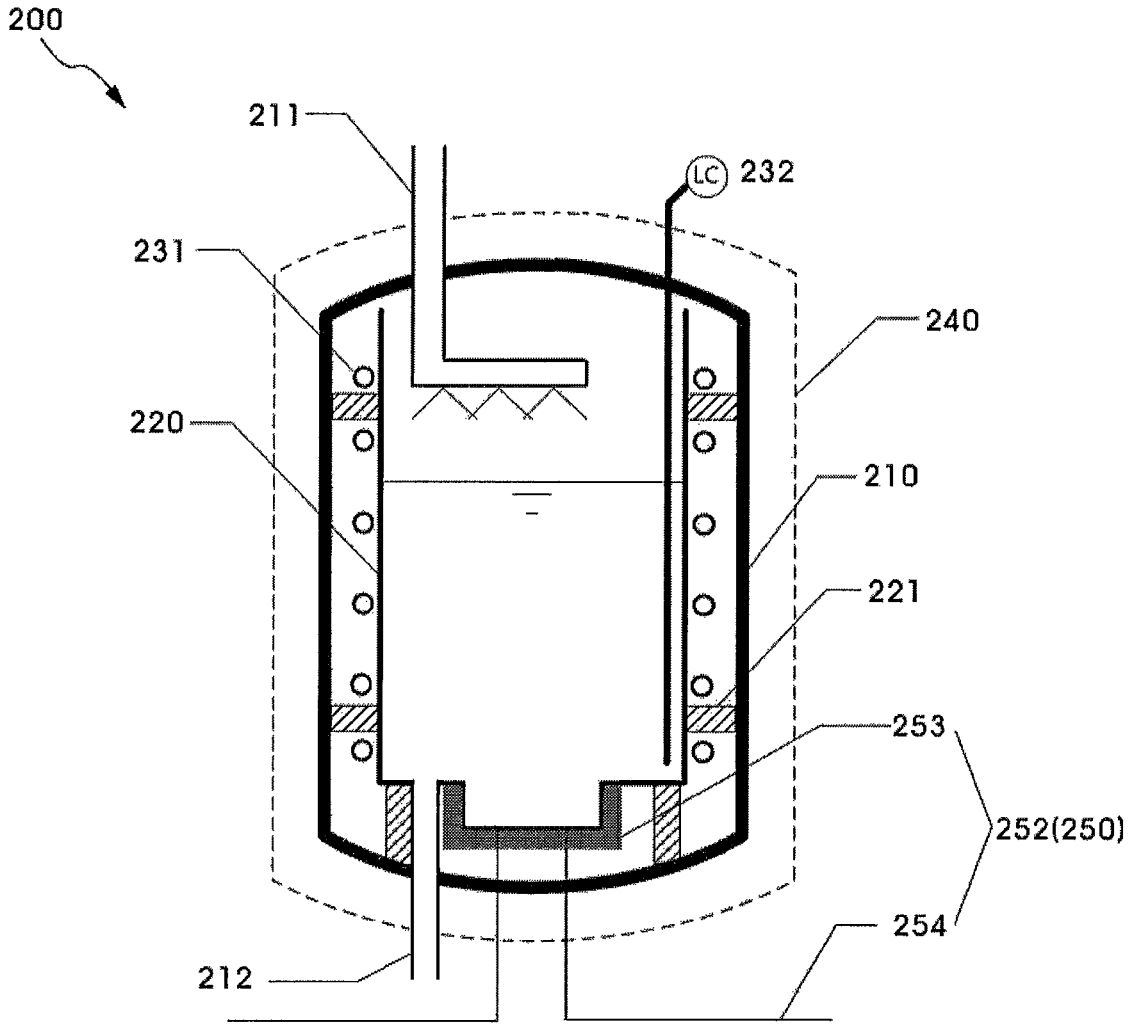
Figure 17:
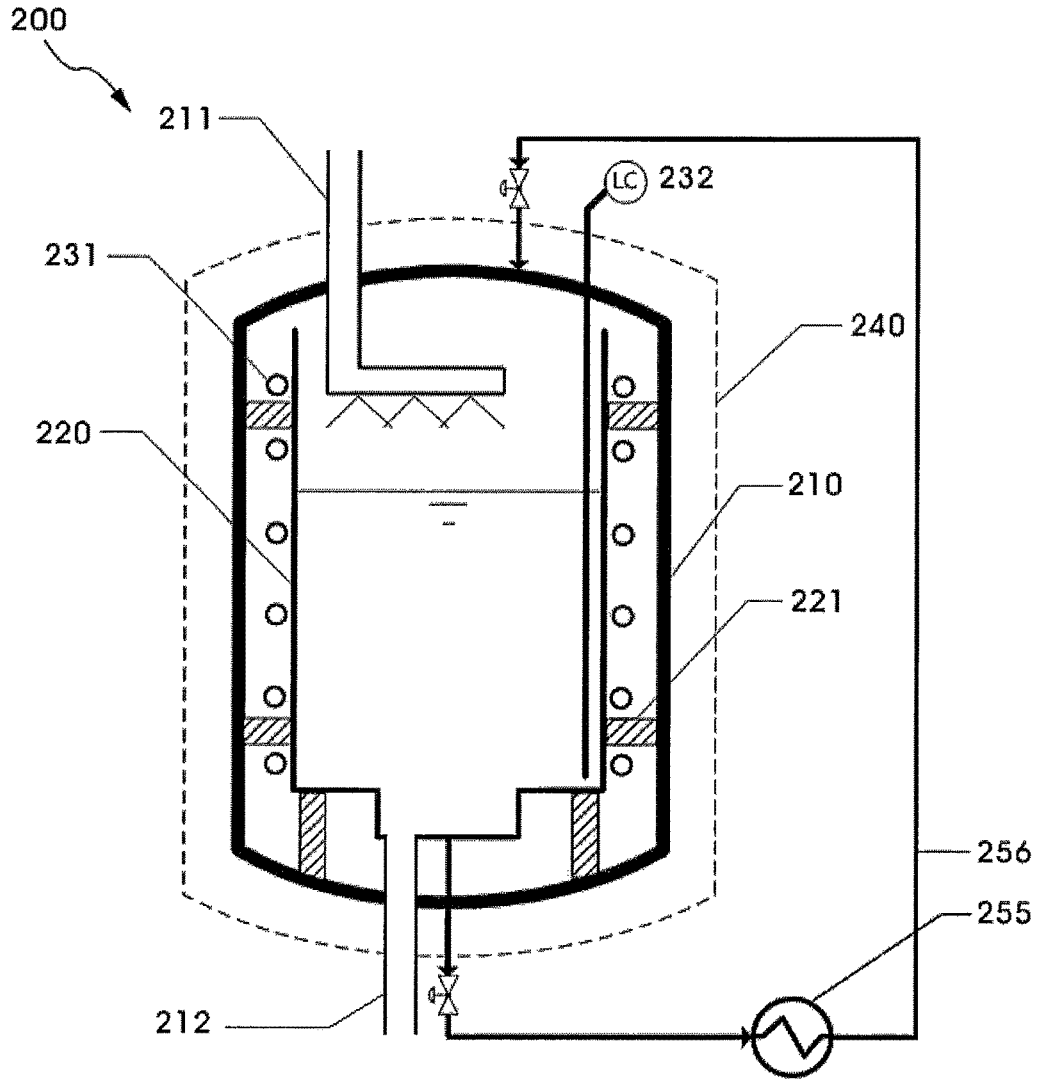

Moreover, the apparatus 1000 for pressurizing delivery of the low-temperature liquefied material according to the embodiment of the present invention may use various forms of heating units 250 and these are shown in FIGS. 15 to 17.

A heating unit 250 shown in FIG. 15 shows a form of the heat exchanger 251 in which a heating medium source having a relatively higher temperature than the liquefied material included in the internal container 220 flows.

In this case, the heating unit 250 of the form of the heat exchanger 251 heats the liquefied material by heat-exchanging the liquefied material with the heating medium source. As the heating medium source, steam or brine may be used.

FIG. 16 shows a form of another heating unit 250 of the pressurizing part 200 of the apparatus 1000 for pressurizing delivery of the low-temperature liquefied material according to the embodiment of the present invention.

In the example shown in FIG. 16, the heating unit 250, which is in a form of an electrical heater 252 provided in the heater, is configured to include a heating line 253 and a power supply 254.

The heating line 253 is advantageously included to be attached to the outside of the internal container 220 as shown in FIG. 16.

The example described above may simplify the system by forming the heating unit 250 in the form of the electrical heater 252. In addition, the pump for circulating the heating medium source needs not to be used and cost consumed to heat the liquefied material may also be decreased. The specific example will be described as follows.

LNG1-->Heater-->LNG2

(1 bar, −161.5° C., H: −5929) (LH=5329−4804=525 KJ/Kg) (6 bar, −120° C., H: −4804)

In the case in which the low-temperature liquefied material is an LNG, about 525 kJ/kg is required for manufacturing the high-pressure gas LNG2 by heating the liquefied material LNG1 in the low-temperature and low-pressure liquefied material tank 100. In addition, assuming that a supply flow rate of the LNG is 2. It/h, electrical energy of a total of 291.66 kW is consumed. Calculating this based on 70 won per 1 kWh, it may be appreciated that about 20,000 won per hour is consumed for liquefying the LNG. That is, it may be confirmed that the case of directly heating using electricity is much more economical as compared to the energy consumed for operating the pump for circulating the heating medium source. Moreover, the heating line 253 is advantageously provided at a lower portion of the outside of the internal container 220 among the outside regions of the internal container 220.

In the case in which the heating line 253 is provided to surround the entire internal container 220, since portions in which unnecessary heating is performed may be generated when an internal level of the internal container 220 becomes lower, the heating line 253 is advantageously provided outside the internal container 220, particularly, a lower region thereof.

FIG. 17 shows an example of another heating unit 250 of the pressurizing part 200 of the apparatus 1000 for pressurizing delivery of the low-temperature liquefied material according to the embodiment of the present invention.

The example shown in FIG. 17 shows a form in which the heating unit 250 is provided outside the pressurizing part 200, where the heating unit 250 is formed to include an inlet and an outlet in communication with the internal container 220 by penetrating through the pressure container 210 so that the liquefied material in the internal container 220 is circulated and heated to thereby heat the entire internal container 220, a circulating path 256 in which the liquefied material .in the internal container 220 is circulated by connecting between the inlet and the outlet, and an external heat source 2.55 formed on the circulating path 256.

The external heat source 255, which is in a form of the heat exchanger 251 heating the liquefied material by heat-exchanging the heating medium source having a relatively higher temperature than the liquefied material passing through the circulating path 256 with the liquefied material, may use a form heating the liquefied material by heat-exchanging the liquefied material with the heating medium source.

In this case, the form of the heat exchanger 251 may be formed in a form of a general heat exchanger 251 in which the liquefied material flows in the inside thereof and the heating medium source flows in the outside thereof, formed in a form of a heterogeneous heat exchanger 251 in which heterogeneous fluids flow the inside therein to heat-exchange with each other, or the like, and may be formed in any form without departing from the technical sprit of the present invention.

In addition, the external heating source 255, which is in a form of the electrical heater 252 using power, may be formed to directly heat the liquefied material passing through the circulating path 256.

Of course, the form of the external heat source 255 is not limited to the foregoing examples, but may be formed in any form as long as the external heat source 255 provided on the circulating path 256 may heat the liquefied material.

As shown in FIG. 17, in the case in which the heating unit 250 is formed in a form having the heat source, the heating unit 250 may be modified and practiced in a form desired by the designer and there is no need to worry about the leakage problem regardless of any heating method used.

The present invention is not limited to the above-mentioned exemplary embodiments but may be variously applied, and may be variously modified by those skilled in the art to which the present invention pertains without departing from the gist of the present invention claimed in the claims.

The invention claimed is:

1. An apparatus for pressurizing delivery of a low-temperature liquefied material and converting the low-temperature and low-pressure liquefied material into a gas form and supplying the converted gas form to a fuel consuming source, the apparatus comprising:

a liquefied material tank storing the low-temperature and low-pressure liquefied material;

a pressurizing part including a heating unit to pressurize the low-temperature and low-pressure liquefied material supplied from the liquefied material tank;

a connecting pipe connecting the liquefied material tank, the pressurizing part, and the fuel consuming source to one another;

a parallel pipe connecting between the liquefied material tank and the pressurizing part, and a pressure balance valve provided on the parallel pipe and adjusting a pressure to achieve pressure balance between the liquefied material tank and the pressurizing part;

a heat adjusting part adjusting a high-temperature and high-pressure liquefied material passing through the pressurizing part to a necessary temperature and pressure of the fuel consuming source;

a high-pressure pump pressurizing the liquefied material at a front side of the heat adjusting part of the connecting pipe; and an over-cooling part connected to an inside of the liquefied material tank by a first transport pipe and disposed at a front side of the high-pressure pump on the connecting pipe, such that the liquefied material supplied in a pressurized state through the connecting pipe is heat-exchanged with the low-temperature liquefied material supplied through the first transport pipe so as to be over-cooled.

2. The apparatus for pressurizing delivery of the low-temperature and low-pressure liquefied material of claim 1, further comprising:

a supplying valve formed on the connecting pipe connecting between the liquefied material tank and the pressurizing part; and an adjusting valve formed on the connecting pipe connecting between the pressurizing part and the heat adjusting part.

3. The apparatus for pressurizing delivery of the low-temperature and low-pressure liquefied material of claim 2, wherein in addition to the connecting pipe connecting between the liquefied material tank and the heat adjusting part is at least one additional connecting pipe, in addition to the pressurizing part is at least one additional pressurizing part installed on each additional connecting pipe, respectively, in addition to the supplying valve is an additional supply valve installed at a front side of each additional pressurizing part on each additional connecting pipe, respectively, in addition to the adjusting valve is at least one additional adjusting valve installed at a rear side of each additional pressurizing part on each additional connecting pipe, respectively, and in addition to the pressure balance valve is at least one additional pressure balance valve provided on additional parallel pipes, respectively, and the pressure balance valves adjust pressure so that the pressure balance between the liquefied material tank and the pressurizing parts is achieved.

4. The apparatus for pressurizing delivery of the low-temperature and low pressure liquefied material of claim 2, further comprising an auxiliary pressurizing part provided between the liquefied material tank and the over-cooling part in parallel with the pressurizing part by a branched connecting pipe and pressurizing the low-temperature and low-pressure liquefied material supplied from the liquefied material tank by having a high-pressure gas supplying part supplying a high-pressure inert gas formed therein, and wherein the low-temperature and low-pressure liquefied material transported from the liquefied material tank by an adjustment of an auxiliary supplying valve adjusting the flow of the liquefied material supplied to the auxiliary pressurizing part is selectively supplied to the auxiliary pressurizing part, and the auxiliary pressurizing part has a plurality of first baffles spaced in a height direction provided therein and alternately extended from left and right sides, respectively, such that the liquefied material introduced into the auxiliary pressurizing part flows in a zigzag form.

5. The apparatus for pressurizing delivery of the low-temperature and low-pressure liquefied material of claim 4, further comprising a second transport pipe branched from the connecting pipe connecting between the high-pressure pump and the heat adjusting part and a second transport valve provided on the second transport pipe.

6. The apparatus for pressurizing delivery of the low-temperature and low pressure liquefied material of claim 5, further comprising a third transport pipe branched from the connecting pipe connecting between the heat adjusting part and the fuel consuming source and a third transport valve provided on the third transport pipe.

7. The apparatus for pressurizing delivery of the low-temperature and low-pressure liquefied material of claim 6, further comprising a plurality of second baffles spaced in an inside of the pressurizing part in a height direction and alternately extended from the left and right sides, respectively.

8. The apparatus for pressurizing delivery of the low-temperature and low-pressure liquefied material of claim 2, wherein the pressurizing part includes:

a pressure container having a liquefied material injecting nozzle connected to the connecting pipe and spraying the supplied liquefied material into an inside and a discharging part, and the heating unit is located inside or outside of the pressure container.

9. The apparatus for pressurizing delivery of the low-temperature and low-pressure liquefied material of claim 8, wherein a heating medium source uses steam, brine or electricity.

* * * * *